US006024041A

United States Patent [19]

Eglais

[11] Patent Number: 6,024,041

[45] Date of Patent: Feb. 15, 2000

[54] HYDROFOIL ASSISTED TRIMARAN

[76] Inventor: Aldis Eglais, Maskavas Street 291/5-26, LV-1063 Riga, Latvia

[21] Appl. No.: 09/051,691

[22] PCT Filed: Aug. 19, 1997

[86] PCT No.: PCT/LV97/00003

§ 371 Date: Apr. 17, 1998

§ 102(e) Date: Apr. 17, 1998

[87] PCT Pub. No.: WO98/07615

PCT Pub. Date: Feb. 26, 1998

[30] Foreign Application Priority Data

Aug. 19, 1996 [LV] Latvia ..... P-96-338

[51] Int. Cl.[7] ..... B63B 1/26; B63B 1/30

[52] U.S. Cl. ..... 114/274; 114/39.24; 114/61.1

[58] Field of Search ..... 114/39.24, 274, 114/280, 282, 283, 61.1

[56] References Cited

U.S. PATENT DOCUMENTS

| | | | |
|---|---|---|---|
| 3,598,076 | 8/1971 | Saxton | 114/274 |
| 3,802,366 | 4/1974 | Mankawich | 114/39.24 |
| 3,949,695 | 4/1976 | Pless . | |
| 4,027,614 | 6/1977 | Jones | 114/163 |
| 5,054,410 | 10/1991 | Scarborough . | |
| 5,168,824 | 12/1992 | Ketterman . | |

FOREIGN PATENT DOCUMENTS

| | | |
|---|---|---|
| 2 379 425 | 9/1978 | France . |
| 2 454 956 | 4/1979 | France . |
| 2 563 177 | 10/1985 | France . |
| 2 220 170 | 1/1990 | United Kingdom . |
| WO94/23989 | 10/1994 | WIPO . |

OTHER PUBLICATIONS

Multihull International No. 192, vol. 17, Jan. 1984, pp 10–11.

Multihull International No. 197, vol. 17, Jun. 1984, pp 141–144.

*Primary Examiner*—Sherman Basinger

*Attorney, Agent, or Firm*—Colin P. Abrahams

[57] ABSTRACT

The present invention relates to a hydrofoil system of a sailing-trimaran having a central hull and two outriggers. Inclined, retractable foils are placed in a head of each outrigger, forward of the center of area of a sail and from the center of gravity of the trimaran. Two additional hydrofoils are arranged each on the stern of an outrigger so that each is clear of the water if the side wind pressure effecting the sail is low. A third additional hydrofoil is arranged on a rudder in the stern of the central hull.

5 Claims, 1 Drawing Sheet

HYDROFOIL ASSISTED TRIMARAN

FIELD OF THE INVENTION

The present invention relates to shipbuilding, and more particularly to a hydrofoil system of sailing-trimarans.

DESCRIPTION OF THE PRIOR ART

It is known that, as a watercraft gathers speed, its drag increases dramatically. An efficient way to diminish the drag is to use the hydrofoils which generate, at sufficient speeds, a hydrodynamic lifting capacity and lift a hull clear of the water. At such high speeds, the drag of hydrofoils is a number of times lower in comparison with the drag of a floating hull.

The use of hydrofoils is also very efficient in increasing the speed of windpowered watercraft. Modern windpowered multihulls, particularly the trimarans, are sufficiently high-speeded and light to be lifted, due to hydrodynamic lift, completely or partially clear of the water, and thereby, the drag is essentially diminished. A specific requirement regarding the windpowered watercraft is to provide the required stability, because the total force of a wind, as well as its direction and magnitude can vary in a wide range. The hydrofoil system of a cruising/racing yacht oriented to real conditions and to a wide range of yachtsmen must also be efficient in a rough sea, but, at a light breeze, when the speed is not sufficient to generate the lift, the drag of the hydrofoil system should be minimal. Such a hydrofoil system should not increase substantially the costs of a boat and cause additional inconvenience in operating. Existing hydrofoil systems meet these requirements only partially, therefore their use is still limited.

For example, in U.S. Pat. No. 5,168,824 a hydrofoil assisted watercraft of a trimaran type is described. The disclosed construction of foil suspended watercraft can only be used for short trips in waters sheltered from the high, breaking waves and is efficient only with sufficiently strong wind, when a hull and the outriggers are completely lifted clear of the water by hydrodynamic lift. At a light breeze, when a craft floats on the hull and the outriggers, the hydrofoils having maximal attack angle, the cantilevers and the canards all together generate great additional drag. The cantilevers and the canards hinder a mooring, but deep-positioned hydrofoils cause additional inconvenience in the shallow water.

Another hydrofoil system assisting in offshore cruising trimaran is described in Multihull International, June 1984, No. 197, 141–144, and it consists of two curved, liftable foils, arranged one on each outrigger, and of a daggerboard on a central hull. The main shortcoming of this system lies in the fact that, as the side wind pressure and hydrofoil lift increase, the stability of the trimaran decreases. The weight of the trimaran is transferred to the leeward outrigger which receives the concentrated force of the hydrofoil's dynamic lift, which lessens the waterplane moment of inertia of an outrigger and increases the pitching amplitude. Submersing of the forepart of the outrigger causes the decrease of hydrofoil's attack angle and of hydrodynamic lift force, but the lifting of the forepart of the outrigger causes an increase in said attack angle and lift force. As the hydrofoil is displaced forward from the axis of pitching oscillations, the alteration of hydrodynamic lift force stimulates an increase of pitching amplitude and decreases even more the longitudinal stability of the trimaran.

The closest prior art to the present invention is a construction of an offshore racing trimaran with a hydrofoil system consisting of an inclined foil on each of the outriggers and a keel with an A-shaped additional foil, where the keel is moved aside the centre of central hull in the direction of its stern, shown in the Multihull International, January 1984, No. 192, p. 10–11.

This placement of hydrofoils also illustrates the main shortcoming of the scheme described above, namely, the decrease of the longitudinal stability with the increasing of side wind pressure and hydrofoil lift. The distance in a longitudinal direction between the A-shaped foil on the keel and the foils on the outriggers is too small to serve as a stabilizing factor. In a choppy sea, a lateral movement of water in fluctuating mutually opposite directions takes place along the trajectories of the central hull and leeward outrigger of the trimaran. If the trimaran has both the keel or the daggerboard on the central hull and inclined foil on the outrigger, fluctuating, mutually opposite movement of water periodically varies the hydrodynamic lift of the inclined foil, which causes bouncing of the outrigger and increases the drag.

Using hydrofoil systems as described above would not give a speed advantage, because insufficient stability of the trimaran in a strong wind increases the tendency to pitch-poling (onward capsize) and requires reducing the area of sails, until a significant portion of the central hull is lifted clear of the water.

The main object of the present invention is to provide a hydrofoil system which hydrodynamically lifts the trimaran's hull, and, at the same time, increases its longitudinal stability to eliminate the capsizing and pitch-poling risk, while the central hull is lifted clear of the water. Further objects of the present invention are to diminish the drag of the hydrofoil system in a light breeze, to decrease the draught of the hydrofoils in shallow water, and to reduce the total production costs.

SUMMARY OF THE INVENTION

The objects of the present invention may be achieved by abandoning a centreboard or keel in the central hull and replacing it with an inclined, retractable or stationary foil on each of the outriggers, and by arranging additional foils at the stern of each outrigger. Additional foils can be attached to the rudders, if these are arranged at the sterns of outriggers.

Preferably, the sterns of the outriggers are lifted and additional foils at the sterns of the outriggers are arranged so as to let them, at low side wind pressure, be substantially clear of the water.

Preferably, inclined foils are placed at the head of the outriggers onwards from the centre of gravity of the trimaran and from the centre area of the sails.

A third additional foil is mounted on the rudder which is stationary or can be lifted in the stern of the central hull.

BRIEF DESCRIPTION OF THE DRAWINGS

FIG. 3 is a top view of a trimaran, wherein

G is the centre of gravity of a trimaran,

R is the hydrodynamic force acting on the submersed inclined foil of the outrigger, RY is a lateral component of the force R, RZ is a vertical component of the force R or a hydrodynamic lifting capacity of the inclined foil, D is a lateral force, acting on the sail due to wind pressure, L is a distance in a longitudinal direction between the centre of gravity G of a trimaran and the vertical component RZ of R, L1 is a distance in a longitudinal direction between the force D and the lateral component of RY, W is an apparent wind direction, and $\alpha$ is an attack angle of a sail.

DESCRIPTION OF THE PREFERRED EMBODIMENT

Figure 1:
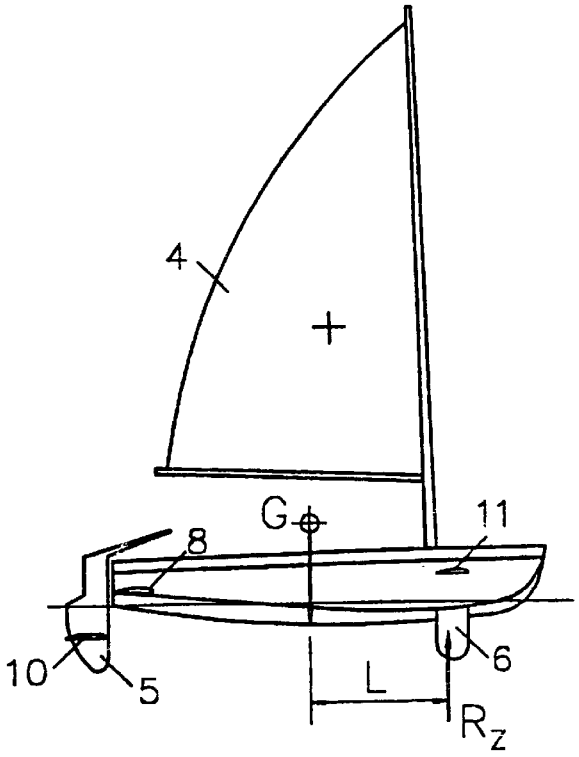
FIG. 1 illustrates a side view of a trimaran from a leeward side in a light breeze where the heel is minimal.
Figure 2:
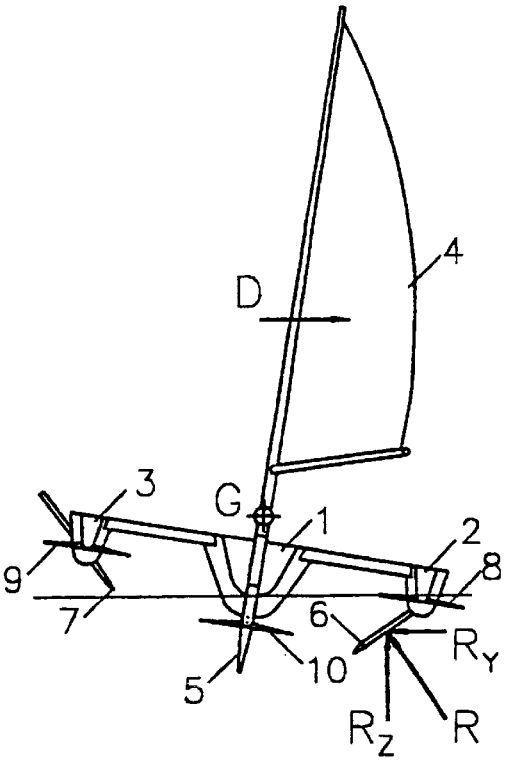
FIG. 2 is a rear view of a trimaran at a strong wind where the heels increased.
Figure 3:
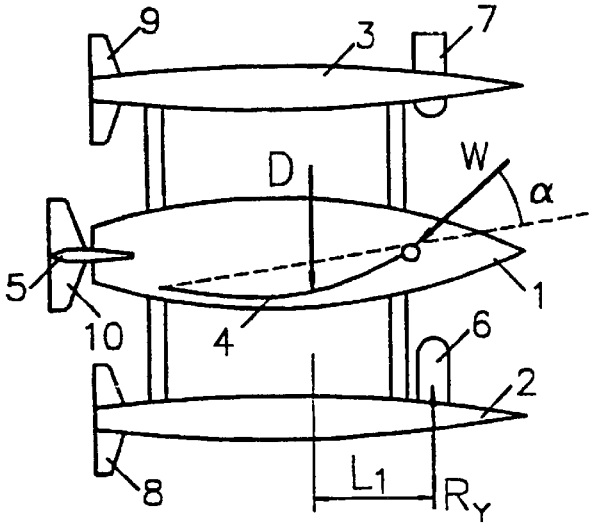

FIGS. 1–3 illustrate a hydrofoil assisted sailing-trimaran in accordance with the present invention.

With reference to figures, the trimaran consisting of a central hull 1, outriggers 2 and 3, a sail 4 and a rudder 5, arranged on the central hull, and provided with a system of hydrofoils. Inclined, retractable foils 6 and 7 with inwardly directed lower ends are arranged inside cases 11 provided in the foreparts of said outriggers 2 and 3. In FIGS. 2 and 3, a foil 7 of windward outrigger 3 is shown in a retracted position. On the sterns of said outriggers 2 and 3 are mounted additional foils 8 and 9, which, at low side wind pressure, are substantially clear of the water. At the central part of said rudder 5, provided on said central hull, the third additional foil 10 is attached.

In operation, the above described elements cooperate in the following manner. The sail of the trimaran expresses force D, caused by a side pressure, while the immersed inclined foil 6 experiences hydrodynamic force R with its lateral component RY and vertical component RZ. The inclined foil 6 always receives a defined portion of the force D, for the reason that the lifting capacity RZ of the inclined foil 6 is always proportional to the force D and does not depend on either a draught of the foil, or the angle of attack of the trimaran. The value of the attack angle of the inclined foil 6 is defined by the side wind pressure, the trimaran's speed and the submersed area of said foil 6. The attack angle of the foil 6 is influenced by the trimaran's drift.

At a light breeze and low side wind the force R, acting on the inclined foil 6 of the leeward outrigger, is minimal, the forepart of the outrigger is slightly submersed, but the stern of outrigger, together with the additional foil 8, is lifted clear of the water, as shown in FIG. 1. The foil 10 on the rudder 5 is immersed under the water, but its attack angle is about 0°, and the drag is minimal. The foil 10 quenches the aft water wave generated by the central hull, thereby reducing the form drag of the central hull of the trimaran. As a result, at a light breeze, the additional drag generated by the system of hydrofoils is minimal.

As the side wind pressure increases, the force R directed on the inclined foil 6 increases accordingly, the central hull of the trimaran is lifted and the portion of weight of the trimaran carried by the leeward outrigger is increased. A considerable part of the total lifting capacity of the leeward outrigger is provided by the vertical component RZ of the force R. This component forms a trimming moment RZ*L against the centre of gravity G of the trimaran. As a result of this moment, the stern of the leeward outrigger, together with additional foil 8, is submersed in the water. The draught and attack angle of additional foil 8 is increased together with the increase of the draught of the stern of the outrigger. The hydrodynamic lift of the additional foil 8 increases accordingly, until it compensates the trimming moment. This dependence of hydrodynamic lift of foil 8 on its draught dynamically stabilizes the trimaran in a longitudinal direction.

As the side wind pressure continues to increase, the central hull is lifted completely clear of the water, due to growing of a different to the aft and increasing the attack angle and lifting capacity of the foil 10. The largest portion of the trimaran weight is carried by the hydrodynamic lift of the foils 6, 8 and 10, but the remaining, insignificant portion of the weight, by the submersed volume of the leeward outrigger which lifts the head of trimaran, when colliding with the waves. If the wind speed, side wind pressure and tractive force of the sails grow even more and the foil 10, together with the rudder 5, is lifted clear of the water, the portion of weight carried by the foil 10 is transferred to the foil 8 and the trimaran gets additional different to the aft. This averts pitch-poling of the trimaran, due to the increase of the tractive force. At the same time, the trimaran is turned against the wind, because inclined foil 6 is located onwards from the centre of the area of the sails and side wind pressure forms, in a horizontal plane, the rotational moment D*L against the foil 6, but the rudder 5 in a lifted position is not able to compensate for this moment. Due to the turn of the trimaran, the attack angle of the sails decreases, reducing the wind pressure, and this averts the lateral capsizing of the trimaran.

As the hydrofoil 10 located on the rudder 5 diminishes the wave, generated by the central hull, and the hull forms drag, the trimaran's weight can be transferred to the aft by increasing the volume of the submersed part of the stern of the hull. At the same time, the length of the additional foils 8, 9 on the sterns of the outriggers can be increased to make them more efficient, because at a light breeze, they are substantially clear of the water and do not generate the drag. In a strong wind, when in the submersed position, they carry the weight and stabilize the trimaran.

In a hydrofoil system according to the present invention only two foils, foil 10 on the rudder in the stern of the central hull and inclined foil 6 on the head of leeward outrigger, are operating simultaneously in a horizontal plane. The longitudinal distance between them is considerable. Therefore, in a choppy sea, lateral movement of a water in fluctuating mutually opposite directions along the trajectories of the central hull and leeward outrigger of the trimaran does not generate fluctuating, mutually opposite hydrodynamic forces, which could cause bouncing of the outrigger and additional drag.

As inclined foils 6 and 7 are placed within their cases 11 and are retractable, like daggerboards, and the rudder 5, together with a foil 10, can be lifted by means of known methods, the hydrofoil system according to the present invention does not cause additional inconvenience in the shallow water.

I claim:

1. A sailing trimaran comprising:

a central hull having a stern rudder;

two side outriggers, one on each side of the central hull;

an inclined hydrofoil located towards the fore of each outrigger;

a stern hydrofoil positioned on the stern of each outrigger;

a rudder foil positioned on the stern rudder of the central hull;

wherein the inclined hydrofoils, stern hydrofoils and rudder foil are arranged with respect to each other so that the inclined hydrofoil and stern hydrofoil of a leeward outrigger and the rudder foil are in an immersed state when the sailing trimaran is located on a body of water, and the inclined hydrofoil and stern hydrofoil of a windward outrigger are substantially clear of the body of water, thereby securing the horizontal stability of the trimaran when in a cruising mode.

2. A trimaran as claimed in claim 1 wherein the stern hydrofoil on each of the outriggers is positioned so as to be substantially clear of the water when the side wind pressure is low.

3. A trimaran as claimed in claim 1 wherein the side outriggers are positioned such that, in use, they are arranged at a height and angle over a water line formed by the body of water whereby the sterns of the outriggers and each stern hydrofoil are clear of the water when the side wind pressure is low.

4. A trimaran as claimed in claim 1 wherein the inclined foil is retractable.

5. A sailing trimaran comprising:

a central hull having a stern rudder;

two side outriggers, one on each side of the central hull;

an inclined hydrofoil located towards the fore of each outrigger;

a stern hydrofoil positioned on the stern of each outrigger;

a rudder foil positioned on the stern rudder of the central hull.

* * * * *